US005606831A

United States Patent [19]

Tippmann et al.

[11] Patent Number: 5,606,831

[45] Date of Patent: Mar. 4, 1997

[54] ENCLOSED MONOLITHIC SWIMMING POOL

[76] Inventors: Joseph R. Tippmann, HRC-33, Box 8419, Rapid City, S. Dak. 57701; Vincent P. Tippmann, 8605 N. River Rd., New Haven, Ind. 46774

[21] Appl. No.: 450,800

[22] Filed: May 25, 1995

[51] Int. Cl.[6] ..... E04H 4/00; E04H 1/00

[52] U.S. Cl. ..... 52/169.7; 52/265; 52/268; 52/741.3; 52/745.05; 4/506; 220/678

[58] Field of Search ..... 52/169.6, 169.7, 52/223.11, 231, 236.6, 268–269, 262, 264, 265, 745.05, 741.3; 4/488, 494, 506, 507, 599, 353; 220/678, 612, 635

[56] References Cited

U.S. PATENT DOCUMENTS

| | | | |
|---|---|---|---|
| 3,315,424 | 4/1967 | Smith | 52/241 X |
| 3,429,085 | 2/1969 | Stillman, Jr. | 4/506 X |
| 3,458,875 | 8/1969 | Michalke et al. | 52/169.7 X |
| 3,559,215 | 2/1971 | Kormann | 52/169.7 X |
| 3,859,674 | 1/1975 | Thomson | 52/169.7 X |
| 3,916,457 | 11/1975 | Morita | 4/506 X |
| 3,971,075 | 7/1976 | Heinbaugh et al. | 4/506 X |
| 3,971,076 | 7/1976 | Ahrens | 4/506 |
| 4,905,326 | 3/1990 | Nakamura et al. | 52/169.7 X |
| 4,948,296 | 8/1990 | Salter | 52/169.7 X |

*Primary Examiner*—Carl D. Friedman
*Assistant Examiner*—Winnie Yip
*Attorney, Agent, or Firm*—Joseph J. Baker, Esq.

[57] ABSTRACT

An enclosed swimming pool is disclosed having floor, side and roof members formed of panels of polyurethane material covered on the interior and exterior surfaces thereof with a layer of fiberglass reinforced resinous material to form a monolithic enclosure for holding a quantity of water and an opening in the side wall member to permit access to the interior of the enclosure.

12 Claims, 3 Drawing Sheets

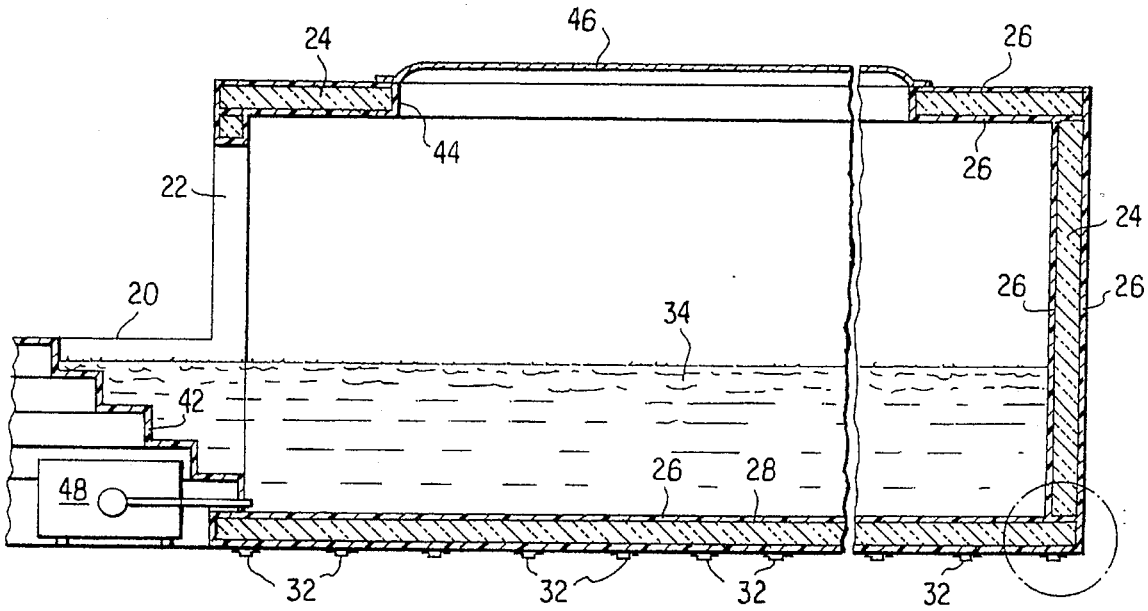
FIG. 3
FIG. 4
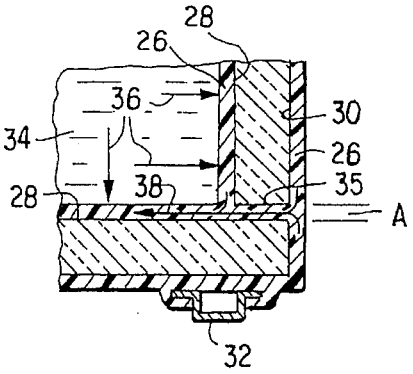
FIG. 4
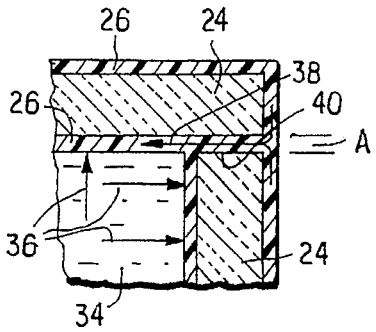
FIG. 6

ENCLOSED MONOLITHIC SWIMMING POOL

BACKGROUND OF THE INVENTION

This invention relates to swimming pools and more specifically to a completely enclosed monolithic swimming pool made entirely of polyurethane material covered with fiberglass reinforced resinous material.

Above ground swimming pools are well known in the art. They vary from the simple, circular kiddie wading pool that can be stepped into to the more elaborate pools that have steps, platforms and other accouterments. Because of the pressure exerted by the body of water contained in these above ground pools, more or less external bracing for the sides is required depending on the size of the pool and the depth of the water contained therein. U.S. Pat. No. 4,577,859 is typical of these prior art pools in that it has a plurality of spaced-apart external bracing members extending between the outside wall of the pool and the surface on which the pool rests.

Most such above ground pools of the prior art are located outdoors which restricts their period of use to the summer months. The surface of the water is usually open to the atmosphere thus requiring constant cleaning and removal of leaves and other airborne debris. This results in the increased use of chemicals to ensure the quality of the water is up to health standards. In addition, the above ground pools of the prior art are normally of steel construction which is prone to rust and have wooden elements that are susceptible to rot.

Applicants' swimming pool fulfills the need and has for its primary object the provision for a superior swimming, physical therapy or exercise pool that is completely enclosed with an entrance opening and that can be located above ground, partially or completely in ground or placed on rooftops or the like.

It is another object of the present invention to provide a swimming pool that is completely insulated throughout enabling the water therein to be economically heated for year-round use.

It is a further object to provide a swimming pool that, due to its unique construction, does not require any external bracing.

It is a still further object to provide a swimming pool that is made of rust- and rot-free polyurethane and fiberglass construction.

It is yet another object to provide a swimming pool that is relatively inexpensive to construct considering its many advantages and that is easy to maintain.

These and other objects will become apparent to those skilled in the art when the foregoing is considered in conjunction with the following brief description of the drawings and detailed description of the preferred embodiments.

BRIEF DESCRIPTION OF THE DRAWINGS

FIG. 3 is a cross-sectional view taken along the lines 3—3 of FIG. 2;

FIG. 4 is an enlarged view of a corner of the enclosed swimming pool as depicted in the circled area of FIG. 3;

FIG. 6 is an enlarged view of a side joint of the enclosed swimming pool as depicted in the circled area of FIG. 5;

DETAILED DESCRIPTION OF THE ILLUSTRATED EMBODIMENTS

Figure 1:
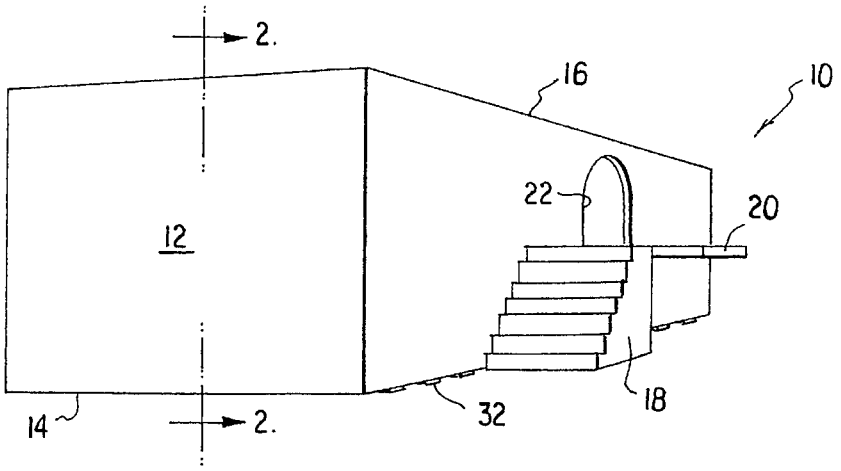
FIG. 1 is a perspective view of a rectangular enclosed swimming pool constructed according to the principles of the present invention.

Referring now to the drawings where like characters of reference refer to similar elements in each of the several views, in FIG. 1, 10 refers to the enclosed swimming pool constructed in accordance with the principles of the present invention. The pool 10 in the embodiment of FIG. 1 is rectangular in shape and comprises a wall member 12, floor member 14, roof member 16 and a set of outside stairs 18 rising to a platform 20. It being understood, of course, the principles of the present invention also apply to pools of circular and other shapes. The stairs 18 and platform 20 are typically constructed separately and attached at the location of use to enable the pool 10 to be transported on a flat bed trailer without requiring the added clearance required if the stairs were integrally formed with one of the sidewalls 12. An opening 22 is also provided in at least one of the sidewalls 12 to enable access to the interior of the pool.

Figure 2:
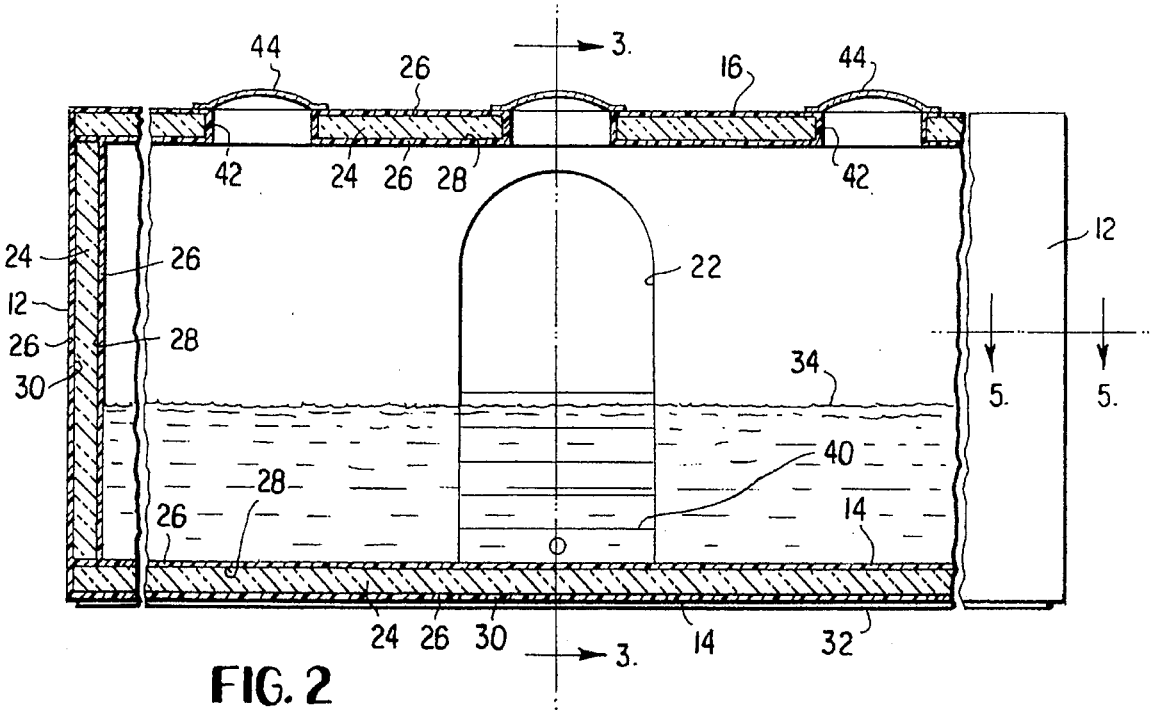
FIG. 2 is a cross-sectional view taken along the lines 2—2 of FIG. 1.

Referring now to FIGS. 2–4, the floor member 14 is comprised of a slab of polyurethane 24 having a layer of fiberglass reinforced resinous material 26 applied to the entire inner surface 28 and a layer 26 of resinous material on the entire outer surface 30 of the slab 24. A plurality of metal reinforcing ribs 32 are positioned in spaced-apart relationship on the resinous material on the lower outer surface 30 and secured thereto by means of the same resinous material as will be more fully described later.

The wall members 12 and the roof member 16 also are comprised of a slab of polyurethane 24 having a layer of fiberglass reinforced resinous material 26 covering the entire inner surface 28 and outer surface 30 of each slab. There is thus formed a continuous inner layer of fiberglass reinforced resinous material 26 covering the entire inside surface 28 of the panels 24 of wall, floor, and roof members 12, 14, 16, respectively. Similarly, there is formed a continuous outer layer of fiberglass reinforced resinous material 26 covering the entire outside surface 30 of the panels 24 of the wall, floor, and roof members 12, 14, 16, respectively. This results in an extremely rigid, monolithic, completely insulated pool structure that is easily handled and transported.

FIG. 4 shows the preferred manner in which the polyurethane foam panels 24 forming the wall member 12 and floor member 14 are positioned and secured relative to each other by means of the fiberglass reinforced resinous material 26 to enable them to withstand the great pressure exerted by the water 34 against the inner surfaces 28 of the wall and floor members 12, 14, respectively, as depicted by the arrow 36. More specifically, a gap A is provided between the end 35 of panel 24 forming the wall member 12 and the inner surface 28 of panel 24 forming the floor member 14. The gap A is thus filled with fiberglass reinforced resinous material 26 and is continuous and integral with the fiberglass reinforced resinous material 26 adjacent the inner and outer surfaces 28, 30, respectively, of the panels 24. There is thus formed a resistance or force depicted by arrow 38 in a direction opposite to the direction of the force 36 exerted by the water 34. This integral connection of the resinous material 26. adjacent the inner and outer surfaces 28, 30, respectively, of the panels 24 comprising the wall and floor members 12, 14, respectively, increases the resistance of the panels 24 to separation by sheer stress occurring as a result of the large outward pressure exerted by the pool water 34 when the water is at its desired level.

Figure 5:
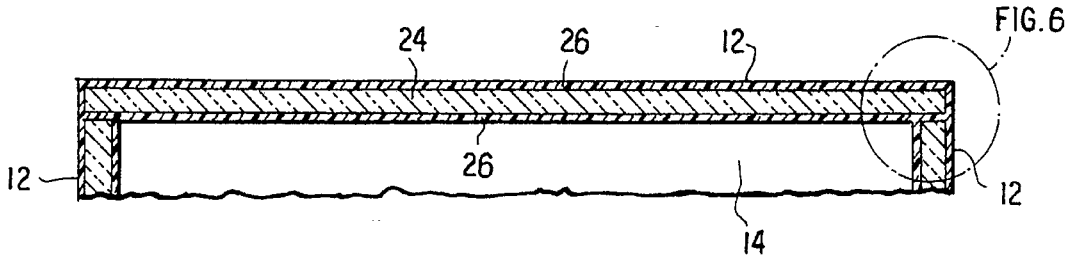
FIG. 5 is a cross-sectional view taken along the lines 5—5 of FIG. 2.

Similarly, FIGS. 5 and 6 show the preferred manner of connection of the polyurethane panels 24 forming the wall member 12. A gap A is formed between the side edge 40 of one of the panels 24 and the inner surface 28 of an adjacent panel 24. Again, a resistance force depicted by arrow 38 is formed in the integral and continuous resinous material 26 in a direction opposite to the direction of the force 36 exerted by the water 34. The same gap A and similar construction can be employed between the panels 24 forming the wall member 12 and the panels 24 forming the roof member 16 if desired.

A set of stairs 42 is provided outside of the pool adjacent to the opening 22. By locating the stairs outside of the pool, the stairs do not obstruct the inner area, thus enabling one to swim the entire width and length of the pool without danger of encountering the stairs. The stairs 42 are formed of the same fiberglass reinforced resinous material 26 and are typically formed integrally with the material 26 covering the inner surface 28 of the wall and floor members 12, 14, respectively. Recesses 44 can also be formed in the roof member 16 to provide light into the interior of the pool. A transparent skylight covering member 46 keeps rain and debris from entering the recesses 44. A conventional pool heater and filter unit 48 can also be provided.

Figure 7:
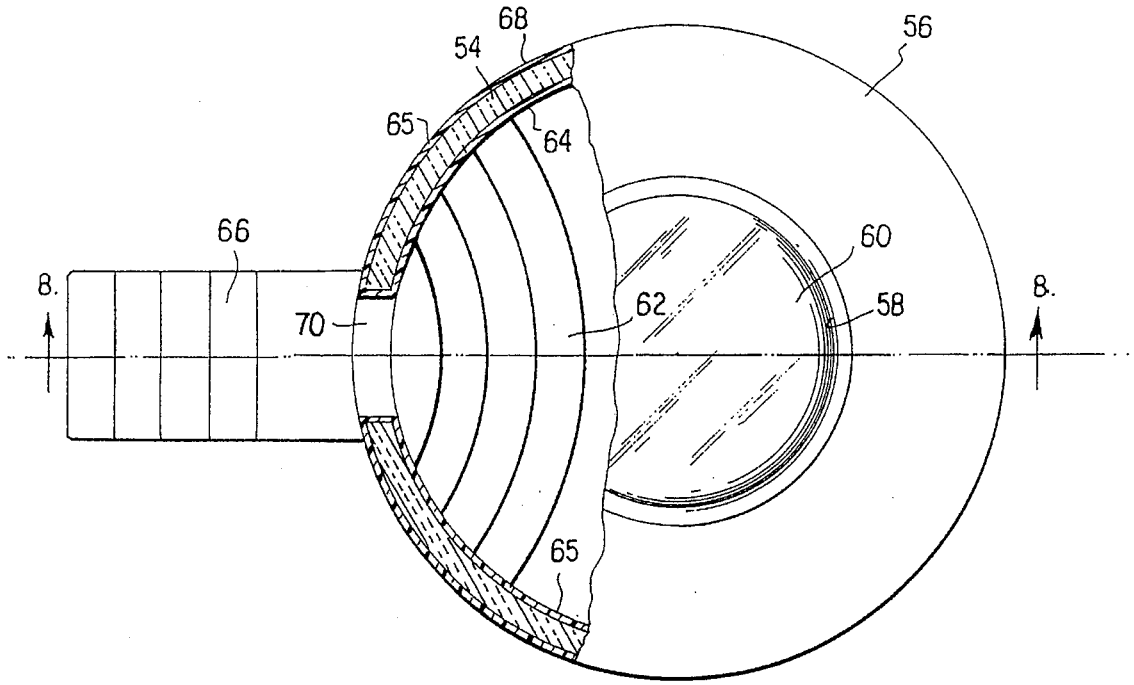
FIG. 7 is a plan view of a circular enclosed swimming pool constructed according to the principles of the present invention with a part broken away.
Figure 8:
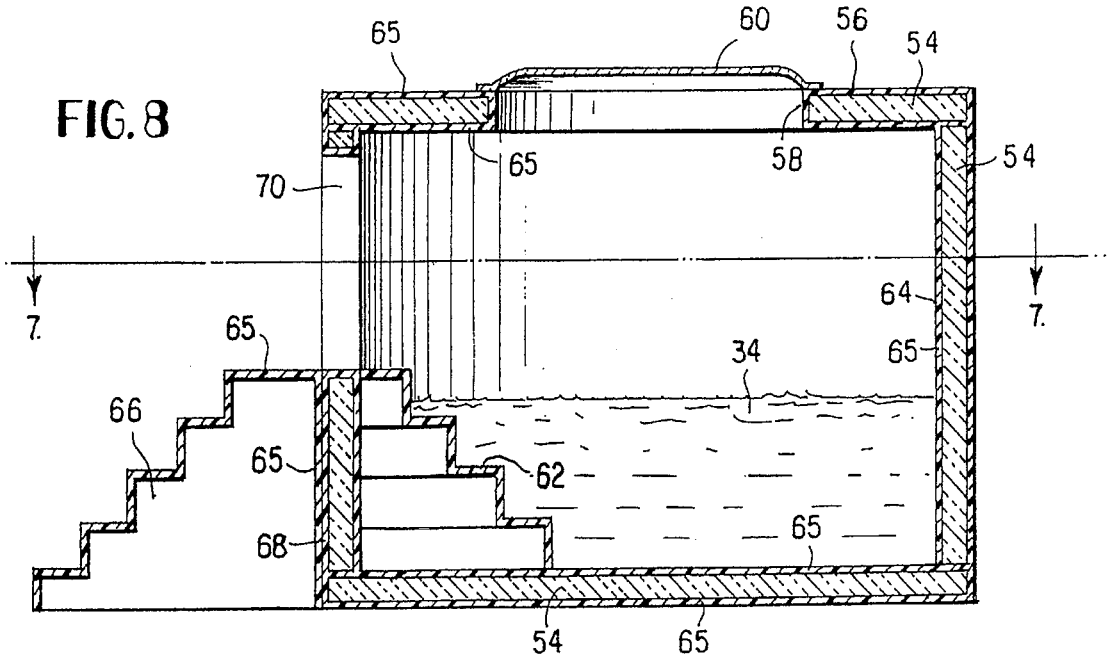
FIG. 8 is a cross-sectional view of the circular pool taken along the lines 8—8 of FIG. 7.

Referring now to FIGS. 7 and 8, there is shown another embodiment of the pool 10 that is cylindrical in shape and has a circular floor member 50 and a wall member 52 having a continuous polyurethane foam panel 54. A roof member 56 completes the enclosure. The roof member 56 has a recess 58 and transparent covering 60 similar to the embodiments of FIGS. 1–4. An inner stairs 62 is also provided integrally formed with the inner surface 64 covering of fiberglass reinforced resinous material 65. An outer stairs 66 can be integrally formed with the outer surface 68 covering of resinous material 65 or it can be constructed separately and mechanically attached thereto. A walk-through opening 70 is located between the stairs 62, 66 in wall member 12 to provide access to the interior of the pool enclosure.

The method by which the monolithic, insulated pool 10 is constructed comprises the positioning of a panel 24 of polyurethane foam (typically 4–6 inches in thickness) on a flat surface. The exposed or upper surface (finished outer surface 30) is coated entirely with a layer of fiberglass reinforced resinous material 26. If a support in the form of a plurality of spaced-apart metal ribs 32 is desired to be located between the underside of the finished pool 10 and the surface upon which the pool rests, these ribs 32 are now positioned on the above-mentioned resinous surface 26 and a layer of fiberglass resinous material 26 is applied to at least a portion of the rib 32 to thereby secure the rib 32 to the first applied resinous surface. The resinous material 26 may entirely cover the rib 32 if it is desired to seal the rib against damage due to moisture, etc.

After the resinous material 26 on the upper surface and ribs 32 has cured, the panel 24 is inverted thus exposing the uncovered inner surface 28 of the panel 24. To this uncovered surface 28 is applied a coating of reinforced resinous material 26 which now forms the inner exposed surface of the floor member 14. Panels 24 of polyurethane foam are now erected vertically on the covered inner surface of the floor member 14 and the exposed inner surface 28 thereof is now covered with a continuous layer of resinous material 26. Similarly, panels 24 of polyurethane are positioned on the vertically erected wall members 12 to form the roof member 16. The exposed inner surface 28 of the roof panels 24 are covered with a layer of fiberglass reinforced resinous material 26 which is seamless, integral and continuous with the layers on the wall members 12 and floor member 14. To complete the enclosure, the entire outer surface 30 of the panels 24 forming the wall and roof members 12, 16, respectively, is covered with a seamless, integral and continuous layer of resinous material 26 including the sides of the openings 22 for access and recess 46 for light. This results in a completely watertight enclosure capable of holding a quantity of water typically between 4 and 6 feet in height. The insulating factor provided by the polyurethane foam panels 24 enables the pool water 34 to be maintained at a comfortable swimming temperature with a conventional heater even during the winter months. The stairs 42 can be positioned inside the enclosure adjacent the opening 22 and covered with a layer of resinous material 26 to secure it to the wall and floor members 12, 14, respectively.

Applicants have thus described in detail their novel monolithic swimming pool and the method of its construction. To those skilled in the art to which this invention pertains, many changes in construction and widely differing embodiments and applications of the invention will suggest themselves without departing from the spirit and scope of the invention. The disclosures and the description herein are purely illustrative and are not intended to be in any sense limiting.

What we claim is:

1. A swimming pool comprising:

(a) a floor member, an upstanding side wall member positioned on said floor member adjacent a peripheral edge thereof and forming a joint therewith, and a roof member positioned on said side wall member and forming a joint therewith, said floor, side wall and roof members being made of polyurethane material and jointed to form a housing having an interior and exterior surface, a monolithic layer of reinforced resinous material entirely covering said interior surface and said joints and a monolithic layer of reinforced resinous material entirely covering said exterior surface and said joints to thereby form a monolithic swimming pool enclosure for holding a quantity of water, and (b) an opening in said side wall member to permit access to the interior of said swimming pool.

2. A swimming pool as set forth in claim 1 wherein a bottom of said opening is spaced a distance above said floor member and stair and platform means are provided adjacent to said opening to facilitate access thereto.

3. A swimming pool as set forth in claim 2 wherein said stair and platform means are detachably secured to said side member adjacent said opening.

4. A swimming pool as set forth in claim 1 wherein said side wall member has an edge surface spaced from said floor member and said edge surface and said floor member are both covered with reinforced resinous material to thereby increase the resistance to separation by sheer stress resulting from the outward pressure exerted by said water in said pool.

5. A swimming pool as set forth in claim 4 wherein said side wall member comprises at least four wall sections and wherein two of said wall sections have an edge surface which is spaced from an adjacent wall section and said edge surface and said adjacent wall section are both covered with reinforced resinous material to thereby increase the resistance to separation by sheer stress resulting from the outward pressure exerted by said water in said pool.

6. A swimming pool as set forth in claim 4 wherein said side wall member has an edge surface which is spaced from said roof member and said edge surface and said adjacent roof member are both covered with reinforced resinous material to thereby increase the resistance to separation by sheer stress resulting from the outward pressure exerted by said water in said pool.

7. A swimming pool as set forth in claim 1 wherein said roof member has a plurality of openings therethrough which are covered by a transparent means to permit light to enter said enclosure.

8. A swimming pool as set forth in claim 1 further comprising means operatively connected to said enclosure to filter and heat said water in said enclosure.

9. A method of making an enclosed swimming pool comprising the steps of:

1) providing a horizontally extending panel of polyurethane material having a flat upper and lower surface to form a floor of said pool, 2) applying a quantity of fiberglass reinforced resinous material to coat at least said upper surface, 3) providing panels of polyurethane material having an inner and outer surface to form walls of said pool, 4) positioning said wall panels vertically adjacent the peripheral edge of said floor panel and on said coated surface thereof, 5) providing a panel of polyurethane material having an inner and outer surface to form roof of said pool, 6) positioning said roof panel on said wall panel, and 7) applying a monolithic layer of fiberglass reinforced resinous material to the entirely cover inner surfaces of said floor, said wall panels, said roof panel and joints therebetween, and 8) applying a monolithic layer of fiberglass reinforced resinous material to entirely cover the outer surfaces of said floor, said side wall panels, said roof panel, and said joints formed therebetween to form said enclosed swimming pool.

10. A method as set forth in claim 9 further comprising the steps of:

1) first applying a quantity of fiberglass reinforced resinous material to said lower surface of said floor panel, 2) permitting said material to cure, and 3) rotating said floor panel to expose said upper surface thereof.

11. A method as set forth in claim 10 further comprising the steps of:

1) positioning a plurality of spaced-apart support members on said layer of fiberglass reinforced resinous material on said lower surface of said floor panel, and 2) applying a layer of fiberglass reinforced resinous material over said support members to secure same to said lower surface of said floor panel.

12. A method as set forth in claim 9 wherein said vertically positioned side wall has an upper edge surface and said method comprises the further step of applying a layer of fiberglass reinforced resinous material on said upper edge prior to said positioning said roof panel on said wall panel.

* * * * *